US010378530B2

(12) United States Patent
Arnold et al.

(10) Patent No.: US 10,378,530 B2
(45) Date of Patent: Aug. 13, 2019

(54) DIAPHRAGM PUMP WITH REDUCED LEAK EXTENSION IN THE EVENT OF OVERLOAD

(71) Applicant: ProMinent GmbH, Heidelberg (DE)

(72) Inventors: Christian Arnold, Weinheim (DE); Martin Reinhard, Heidelberg (DE); Roland Elgetz, Eppelheim (DE)

(73) Assignee: ProMinent GmbH, Heidelberg (DE)

( * ) Notice: Subject to any disclaimer, the term of this patent is extended or adjusted under 35 U.S.C. 154(b) by 152 days.

(21) Appl. No.: 15/304,257

(22) PCT Filed: Jul. 10, 2015

(86) PCT No.: PCT/EP2015/065907
§ 371 (c)(1),
(2) Date: Oct. 14, 2016

(87) PCT Pub. No.: WO2016/005596
PCT Pub. Date: Jan. 14, 2016

(65) Prior Publication Data

US 2017/0037840 A1 Feb. 9, 2017

(30) Foreign Application Priority Data

Jul. 11, 2014 (DE) ..... 10 2014 109 801

(51) Int. Cl.
*F04B 43/067* (2006.01)
*F04B 43/073* (2006.01)
(Continued)

(52) U.S. Cl.
CPC ..... *F04B 43/0733* (2013.01); *F04B 43/009* (2013.01); *F04B 43/06* (2013.01); *F04B 43/067* (2013.01); *F04B 2203/0902* (2013.01)

(58) Field of Classification Search
CPC .... F04B 43/0009; F04B 43/009; F04B 43/02; F04B 43/067; F04B 45/0533
(Continued)

(56) References Cited

U.S. PATENT DOCUMENTS 3,254,845 A * 6/1966 Schlosser ..... F04B 43/067 137/539
3,433,161 A * 3/1969 Vetter ..... F04B 43/067 417/388
(Continued)

FOREIGN PATENT DOCUMENTS

CN 101245777 A 8/2008
DE 1 034 030 B 7/1958
(Continued)

OTHER PUBLICATIONS

The State Intellectual Property Office of the People's Republic of China, Chinese patent application No. 201580023902.X, Examiners Action dated Jan. 2, 2018, and English translation.
(Continued)

*Primary Examiner* — Charles G Freay
*Assistant Examiner* — Thomas Fink
(74) *Attorney, Agent, or Firm* — Paul & Paul

(57) ABSTRACT

The present invention concerns a diaphragm pump comprising a delivery chamber separated from a hydraulic chamber by way of a diaphragm, wherein the delivery chamber is respectively connected to a suction connection and a pressure connection and the hydraulic chamber which can be filled with a working fluid can be acted upon with a pulsating working fluid pressure and the diaphragm can be reciprocated between a pressure position in which the volume of the delivery chamber is smaller and a suction position in which the volume of the delivery chamber is larger. In that arrangement the hydraulic chamber is connected to a working fluid
(Continued)

supply by way of a leak replenishment valve, wherein the leak replenishment valve is so designed that when the pressure in the hydraulic chamber in the suction position of the diaphragm is less than a predetermined minimum value $p_{Min}$ the leak replenishment valve opens and the hydraulic chamber has an outlet passage which is closed by a pressure limiting valve which is so designed that if the pressure in the hydraulic chamber rises above a predetermined maximum value $p_{Max}$ the pressure limiting valve opens and working fluid can leave the hydraulic chamber by way of the outlet valve. To provide a corresponding diaphragm pump which automatically reduces the metering power in the overpressure situation without the use of additional sensors being necessary it is proposed according to the invention that the working fluid supply is arranged in a first and in a second chamber, the two chambers being connected together by way of a first connecting passage.

16 Claims, 4 Drawing Sheets

(51) Int. Cl.
*F04B 43/00* (2006.01)
*F04B 43/06* (2006.01)

(58) Field of Classification Search
USPC ..... 417/388
See application file for complete search history.

(56) References Cited

U.S. PATENT DOCUMENTS 3,612,727 A * 10/1971 Drake ..... F04B 43/067 417/388
3,902,826 A * 9/1975 Nagel ..... F04B 23/06 417/386
RE29,055 E * 11/1976 Wagner ..... B05B 9/0409 417/388
4,019,837 A * 4/1977 Eull ..... F04B 43/067 417/386
4,403,924 A * 9/1983 Gebauer ..... F04B 43/067 417/388
4,430,048 A * 2/1984 Fritsch ..... F04B 43/067 417/383
4,436,491 A * 3/1984 Ishiyama ..... F04B 43/067 417/385
4,865,528 A * 9/1989 Fritsch ..... F04B 43/067 417/385
4,934,906 A * 6/1990 Williams ..... F04B 43/107 417/388
5,188,515 A * 2/1993 Horn ..... F04B 43/009 417/63
5,246,351 A * 9/1993 Horn ..... F04B 43/067 417/387
5,655,894 A * 8/1997 Fritsch ..... F04B 43/067 417/387
5,810,567 A 9/1998 Horn
5,860,793 A * 1/1999 Muscarella ..... F04B 43/009 417/385
2007/0140878 A1* 6/2007 Spude ..... F04B 43/0081 417/437
2014/0147292 A1* 5/2014 Fritsch ..... F04B 43/0081 417/53

FOREIGN PATENT DOCUMENTS

DE 74 20 466 U 1/1975
DE 43 27 969 A1 3/1995
DE 44 20 863 A1 12/1995
GB 597106 A 1/1948
GB 1167224 A 10/1969

OTHER PUBLICATIONS

Nora Lindner, The International Bureau of the World Intellectual Property Organization, PCT/EP2015/065907, International Preliminary Report on Patentability, Jan. 26, 2017 (English translation).
China National Intellectual Property Administration, Office Action, dated Apr. 22, 2019, Chinese Application No. 201580023902.X (English Translation).

* cited by examiner

DIAPHRAGM PUMP WITH REDUCED LEAK EXTENSION IN THE EVENT OF OVERLOAD

CROSS-REFERENCE TO RELATED APPLICATION

This application is a 371 national stage application of International Application PCT/EP2015/065907, filed Jul. 7, 2015, and claims the priority of German Application No. 10 2014 109 801.3, filed on Jul. 11, 2014.

The present invention concerns a diaphragm pump with a leak replenishment valve.

Diaphragm pumps generally have a delivery chamber which is separated from a hydraulic chamber by way of a diaphragm, wherein the delivery chamber is connected both to a suction connection and also to a pressure connection. The hydraulic chamber which can be filled with working fluid can then be acted upon with a pulsating working fluid pressure. Under the pulsating working fluid pressure the diaphragm is reciprocated with a pulsating movement between a pressure position in which the volume of the delivery chamber is smaller and a suction position in which the volume of the delivery chamber is larger. In that way it is possible to draw in the delivery medium by way of the suction connection which is connected to the delivery chamber with a suitable non-return valve, when the volume of the delivery chamber is increased, and to discharge the delivery medium under pressure again by way of the pressure connection which is also connected to the delivery chamber with a suitable non-return valve, when the volume of the delivery chamber is reduced.

In general a hydraulic oil is used as the working fluid. In principle however it is also possible to use other suitable fluids.

The medium to be delivered is separated from the drive by the diaphragm, whereby on the one hand the drive is shielded from damaging influences of the delivery medium, while on the other hand the delivery medium is also shielded from damaging influences of the drive, for example impurities.

The pulsating working fluid pressure is frequently produced by means of a moveable piston which is in contact with the working fluid. In that case for example the piston is reciprocated in a hollow-cylindrical element whereby the volume of the hydraulic chamber is reduced and increased, leading to an increase and a reduction in the pressure in the hydraulic chamber and consequently a movement of the diaphragm. In spite of a wide range of different measures which are intended to prevent the working fluid from flowing around the piston in practice the possibility cannot be excluded that, in each stroke movement, a small amount of the working fluid is lost through the narrow gap remaining between the piston and the hollow-cylindrical element, whereby the amount of working fluid in the hydraulic chamber is gradually reduced.

In addition gas can penetrate into the hydraulic chamber, and that gas has to be removed therefrom to permit a full stroke movement of the diaphragm. For that purpose a venting valve is frequently connected to the hydraulic chamber, by way of which, during the pressure stroke, a given amount of gas and possibly a small amount of working fluid is discharged. That also gradually reduces the amount of working fluid in the hydraulic chamber.

The consequence of this is that the pressure stroke is no longer completely implemented by the diaphragm as there is no longer sufficient working fluid available for the pressure stroke movement of the diaphragm.

Therefore for example DE 1 034 030 has already proposed connecting the hydraulic chamber to a working fluid supply with the interposition of a valve, a so-called leak replenishment valve.

If required working fluid can be subsequently introduced into the hydraulic chamber through that leak replenishment valve. In that respect however care is to be taken to ensure that not too much working fluid is introduced into the hydraulic chamber as then the diaphragm in the pressure stroke moves too far into the delivery chamber and under some circumstances comes into contact with valve passages or the internal contour of the pump metering head and is damaged.

In normal operation the leak replenishment valve is of such a design that precisely that amount of working fluid which is lost during the pressure stroke is filled up at the end of the suction stroke, that is to say substantially in the suction position.

The described metering pump is generally used in a corresponding process installation, that is to say it is connected to a corresponding suction line and a pressure line. Even if basically not wanted it can however happen that in the process installation the pressure line is closed by mistake so that the metering pump pumps against a closed volume whereby an inadmissibly high pressure can be developed, and that can lead to damage to the diaphragm or drive components of the pump.

To prevent that therefore the hydraulic chamber is frequently equipped with an outlet passage closed by a pressure limiting valve which is so designed that if the pressure in the hydraulic chamber rises above a predetermined maximum value $p_{max}$ the pressure limiting valve opens so that working fluid can leave the hydraulic chamber by way of the outlet passage and is generally passed back into the working fluid supply.

It is possible in that way to prevent a further rise in pressure.

Due to the oil recycling however there is a marked increase in temperature of the overall hydraulic system, in particular the pressure limiting valve and the hydraulic oil.

Particularly if blocking of the pressure line persists for a relatively long period of time the temperature of the pump can rise markedly as, in each pressure stroke, hydraulic liquid has to be discharged by way of the pressure limiting valve again and returned by way of the leak replenishment valve.

Depending on the respective area of use of the metering pump however certain temperature categories are to be observed in accordance with ATEX Directives of the European Union. An increase in the temperature of the pump is therefore only allowed to a certain degree.

To comply with the requirements of the ATEX Directives various measures are known in the state of the art. For example the stroke frequency and consequently also the metering power can be limited so that, even upon blockage of the pressure line, the limit temperature is not exceeded at any location within the pump. That measure however leads to a markedly reduced metering power as the pump, even if there is no blockage of the pressure line, is operated with a restricted stroke frequency. In addition the pump-specific limit power has to be determined in a correspondingly complicated and laborious procedure.

A further possible way of complying with the ATEX Directives involves using a suitable temperature sensor which detects the temperature of the pump, preferably in the proximity of the pressure limiting valve, and, when the limit temperature is exceeded, outputs a signal which then leads to the pump being shut down. A temperature sensor however has to be provided due to that measure. In addition the signal supplied by the temperature sensor has to be appropriately prepared and processed.

A further possible solution involves the use of a flow monitor in the outlet passage which in the overpressure situation detects the hydraulic oil flow by way of the pressure limiting valve and provides for shutdown of the pump.

Here too additional costs are involved for the flow monitor and the electronic signal processing system connected thereto.

Therefore in consideration of the described state of the art the object of the present invention is to provide a diaphragm pump which automatically reduces the metering power in an overpressure situation without needing to use additional sensors.

According to the invention that object is attained in that the working fluid supply is arranged in a first and a second chamber, wherein the two chambers are connected together by way of a first connecting passage.

In that arrangement the connecting passage is either closable or the flow through the connecting passage is throttled or at least can be throttled so that in an overpressure situation, that is to say when the hydraulic oil has left the hydraulic chamber by way of the pressure limiting valve, more hydraulic oil is subsequently passed from the first chamber into the hydraulic chamber than can subsequently flow during a stroke from the second chamber into the first chamber.

In the situation where the outlet passage is connected to the working fluid supply that can then be connected to the second chamber of the working fluid supply.

The amount of working fluid that flows past the piston can also be returned to one of the two chambers.

Depending on the respective configuration therefore the overpressure situation has the result that the pressure in the first chamber and/or the filling level in the first chamber falls as less working fluid can subsequently flow from the second chamber into the first chamber, than is discharged by way of the leak replenishment valve from the first chamber into the hydraulic chamber.

As soon as the filling level or the pressure in the first chamber falls below a given value however gas is passed into the hydraulic chamber by way of the leak replenishment valve. If however there is gas in the hydraulic chamber that results in a reduced movement of the diaphragm because of the compressibility of the gas so that the metering power is reduced and thus the increase in temperature of the metering pump above a predetermined maximum temperature is prevented.

The measure according to the invention therefore ensures that in the overpressure situation gas passes into the hydraulic chamber and thereby prevents a further rise in temperature of the pump.

In an embodiment the connecting passage is closable by means of a valve.

The valve is generally closed during operation of the pump. That amount of working fluid which has escaped by way of the piston or the venting valve is replenished by way of the leak replenishment valve. That amount however is very small so that the level of working fluid in the first chamber falls only very slowly. The first chamber can be of such a size that in that condition the pump can be operated for several days or even weeks without the level or the working fluid pressure falling to such an extent that gas passes into the hydraulic chamber by way of the leak replenishment valve.

It is also possible for the working fluid which flows past the piston to be returned to the first chamber whereby the drop in the level of fluid is slowed down.

In the overpressure situation however the amount of working fluid to be subsequently introduced by way of the leak replenishment valve increases greatly so that the level or the working fluid pressure falls quickly and gas passes into the hydraulic chamber.

As soon as gas has penetrated into the hydraulic chamber the function of the pump is disturbed and a further rise in temperature excluded.

In order to resume operation of the pump the valve of the connecting passage has to be opened so that the first chamber is filled again with sufficient working fluid. As in each working stroke a given volume of gas is conveyed out of the hydraulic chamber when there is gas in the hydraulic chamber and no further gas is now introduced by way of the leak replenishment valve the pump can operate normally again.

The valve of the connecting passage can be regularly briefly opened, more specifically either manually—for example in a fault situation or during regular checks—or automatically, for example in time-controlled fashion every 24 hours, in order to increase the level of working fluid in the first chamber.

In a further particularly preferred embodiment there is a second connecting passage between the first and second chambers.

In that case the second connecting passage can be arranged above the first connecting passage and preferably above the leak replenishment valve, particularly preferably the second connecting passage being arranged above the level of working fluid in the second chamber.

If the second connecting passage is arranged above the level of working fluid in the two chambers it provides for pressure equalization between the first and second chambers. The second connecting passage can be of a large cross-section so that the pressure in the first and second chambers is always the same. The first connecting passage however is of such a size that in the overpressure situation, as already described above, more working fluid is discharged from the first chamber into the hydraulic chamber than can flow from the second chamber into the first chamber by way of the first connecting passage.

As a result the level of working fluid in the first chamber will fall. As soon as the level of working fluid in the first chamber is at the height of the leak replenishment valve less working fluid and in addition gas are subsequently introduced into the hydraulic chamber. If however there is gas in the hydraulic chamber that results in a reduced movement of the diaphragm, by virtue of the compressibility of the gas, so that the metering power is reduced and thus the rise in temperature of the metering pump above a predetermined maximum temperature is prevented. As soon as the blockage of the pressure line is removed no more working fluid will escape from the hydraulic chamber by way of the pressure limiting valve. The gas in the hydraulic chamber is then successively discharged by way of the venting valve. As now less hydraulic fluid is required in the hydraulic chamber the level of working fluid in the first chamber will rise again and the metering power will increase again.

An alternative embodiment provides that the first chamber is of such a design that working fluid can pass into the first chamber only by way of the first connecting passage. In that case therefore no pressure equalization is possible by way of a second connecting passage. In the overpressure situation, as more working fluid is transferred from the first chamber into the hydraulic chamber by way of the leak replenishment valve than working fluid can flow from the second chamber into the first chamber, that means that the pressure of the working fluid in the first chamber is markedly reduced. Due to the reduction in pressure the hydraulic oil experiences cavitation and thus carries gas into the hydraulic chamber. As a result of this the hydraulic displacement process of the pump is also so severely disturbed that the power draw of the drive falls steeply and consequently an excessive rise in temperature of the hydraulic oil does not occur.

In this embodiment also a second connecting passage may be helpful if it is closed by the non-return valve, wherein the through-flow direction of the non-return valve is arranged in the direction of the second chamber. The non-return valve ensures that the second connecting passage remains closed in all above-described functional states of the pump.

It will be noted however that it may be appropriate for many situations of use for a safety valve or an especially designed leak replenishment valve to recycle at least a part of the working fluid into the first chamber again, to protect the diaphragm if the diaphragm position is not in conformity with the desired position. That is the case for example upon a blockage in the suction line if the diaphragm is not moved back into the suction position and therefore too much working fluid flows into the hydraulic chamber. During the pressure stroke the diaphragm then moves beyond the pressure position, which can lead to damage to the diaphragm. Therefore a safety valve or an especially designed leak replenishment valve can be provided, which opens in the situation where the diaphragm moves beyond the pressure position.

If the safety valve or the leak replenishment valve is so designed that the issuing working fluid is returned to the first chamber the use of the non-return valve in the second connecting passage is advantageous, as then an increased pressure possibly occurring in the first chamber can be delivered to the second chamber by way of the non-return valve.

The leak replenishment valve is advantageously so designed that it has a closing member which is reciprocable between a closed position in which the valve passage is closed and an open position in which the valve passage is opened, and which is held in the closed position by means of a pressure element, wherein the pressure element is so designed that the closing member moves in the direction of the open position if the pressure in the hydraulic chamber is less than a setting pressure $p_{min}$.

In an alternative embodiment the first connecting passage is arranged lower than the leak replenishment valve. In that way the second chamber can be of relatively compact dimensions as it is only necessary for the connecting passage always to be beneath the level of working fluid in the second chamber.

The apparatus according to the invention has the advantage that no external power supply is necessary. In addition no signal processing and evaluation is required, which makes the measure according to the invention maintenance-free and wear-free. No additional components are required.

Further advantages, features and possible uses will be clearly apparent from the description hereinafter of two preferred embodiments and the related Figures in which:

FIG. 1 shows a partial sectional view of a first embodiment according to the invention, FIG. 2 shows a diagrammatic view of the mode of operation of the embodiment of FIG. 1 in normal operation, FIG. 3 shows a diagrammatic view of the mode of operation of the embodiment of FIG. 1 in overpressure operation, FIG. 4 shows a partial sectional view of a second embodiment of the invention, and FIG. 5 shows a diagrammatic view of the mode of operation of the second embodiment of FIG. 4.

Figure 1:
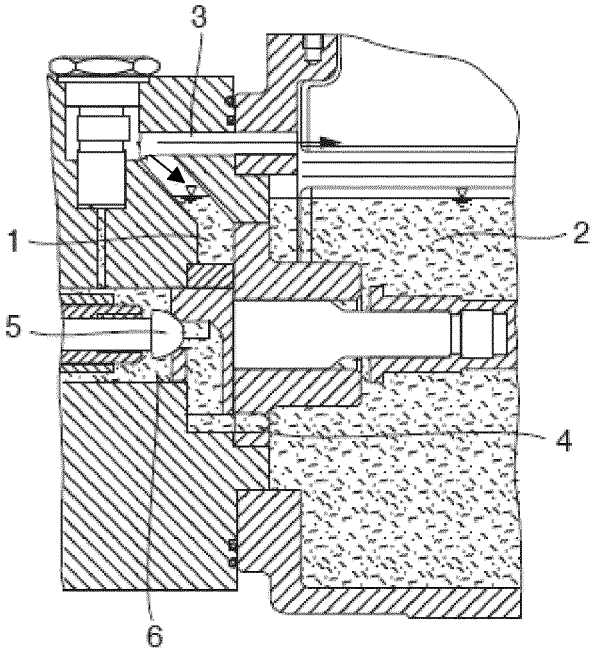

FIG. 1 shows a partial sectional view of a first embodiment of the invention. The diaphragm (not shown) is disposed at the left outside the view in FIG. 1 and is connected to a leak replenishment valve 5 which is resiliently prestressed within the hydraulic chamber 6 and closes the connection between the hydraulic chamber 6 and the first chamber 1 of the working fluid supply. The working fluid is arranged in the first chamber 1 and in the second chamber 2. The first chamber 1 and the second chamber 2 are connected together by way of a first connecting passage 4 which here is in the form of a nozzle.

The nozzle cross-section is so dimensioned that in the overpressure situation more working fluid is discharged into the hydraulic chamber 6 by way of the leak replenishment valve 5 than can be added by way of the nozzle 4. In addition an opening 3 which functions as a second connecting passage is arranged between the first chamber 1 and the second chamber 2. The leak replenishment valve 5 is of such a design that, when too little working fluid is in the hydraulic chamber 6 in particular at the end of the suction stroke, that is to say in the suction position, the leak replenishment valve 5 opens so that working fluid can flow from the first chamber into the hydraulic chamber 6. In normal operation the amount of working fluid which has to be replaced by way of the leak replenishment valve is very small. In the overpressure situation, that is to say for example upon a blockage of the pressure line, the pressure in the hydraulic chamber 6 rises rapidly so that, for safety reasons, working fluid is discharged from the hydraulic chamber 6 by way of a pressure limiting valve (not shown) and is delivered for example into the second chamber 2 of the working fluid supply. In the overpressure situation the leak replenishment valve 5 must pass a markedly larger amount of working fluid out of the first chamber.

Figure 2:
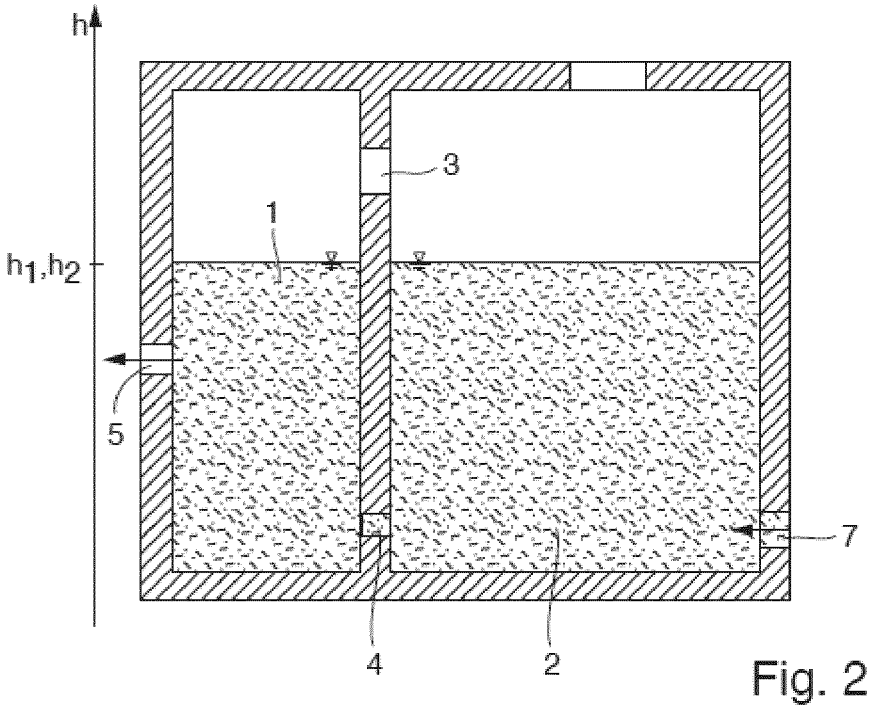
Figure 3:
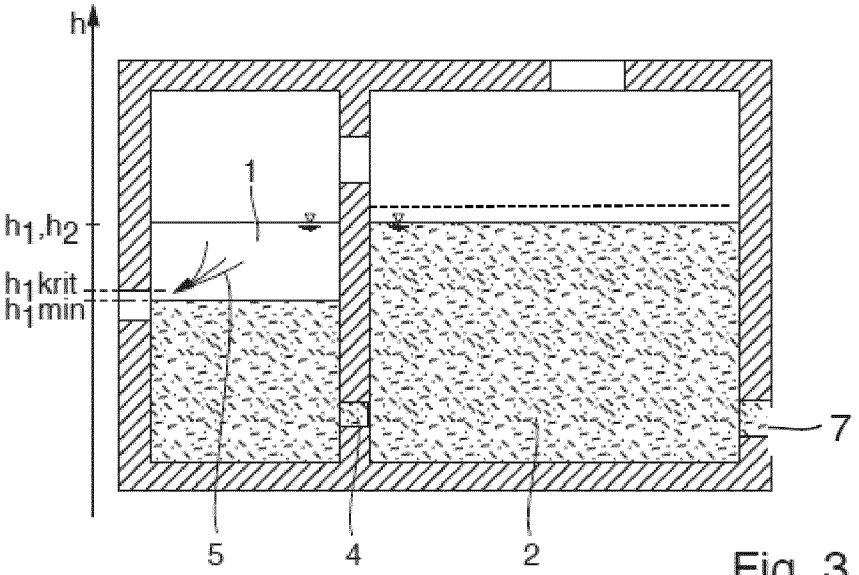

The mode of operation of the metering pump according to the invention will be apparent from the diagrammatic views in FIGS. 2 and 3.

FIG. 2 shows the condition in the normal mode of operation. It is possible to see the working fluid supply comprising the first chamber 1 and the second chamber 2, being connected together by a nozzle 4 which is arranged beneath the fluid level and which functions as a first connecting passage. The second connecting passage is implemented by the opening 3 disposed above the level of working fluid. Upon opening of the leak replenishment valve 5 working fluid flows out of the first chamber into the hydraulic chamber adjoining same to the left in FIG. 2.

At the moment at which the leak replenishment valve 5 is opened working fluid flows out of the first chamber 1 and the level of fluid in the first chamber falls. As soon as the leak replenishment valve 5 is closed again the level of working fluid in the first chamber 1 rises again as working fluid can flow from the second chamber 2 into the first chamber 1 by way of the nozzle 4.

In the normal mode of operation the loss of working fluid in the hydraulic chamber is so slight that, during a complete stroke, the amount of working fluid supplied can be easily supplied through the first connecting passage 4 from the second chamber into the first chamber.

In the overpressure situation however a larger amount of hydraulic fluid is abruptly let out of the hydraulic chamber and is fed to the second chamber 2 of the working fluid supply again by way of a corresponding pressure limiting valve and by way of the feed 7. In the overpressure situation there is an unwanted rise in temperature not only of the recycled hydraulic oil but also of the pressure limiting valve (not shown).

The fact that the working fluid supply is divided according to the invention into two chambers connected by a narrow first connecting passage provides however in the overpressure mode of operation that during a stroke it is no longer possible for sufficient working fluid to flow from the second chamber into the first chamber in order to compensate for the loss of working fluid by way of the pressure limiting valve.

As a result this means that, as diagrammatically shown in FIG. 3, the level of working fluid in the first chamber 1 gradually falls. Sometime the level of working fluid in the first chamber 1 will however be in the region of the opening to the leak replenishment valve 5 so that, when the leak replenishment valve 5 opens, gas is also passed into the hydraulic chamber. As soon as gas is in the hydraulic chamber however the metering power is markedly reduced due to the compressibility of the gas whereby less energy is introduced into the pump and a further rise in temperature fails to occur.

As soon as the overpressure mode of operation is concluded, that is to say a blockage which is possibly present in the pressure line has been removed, the pressure limiting valve will no longer open and therefore a larger amount of hydraulic oil will not leave the hydraulic chamber. In that situation once again more working fluid will flow from the second chamber into the first chamber by way of the nozzle 4 than working fluid is caused to flow from the first chamber 1 into the hydraulic chamber by way of the leak replenishment valve 5 so that the level of working fluid in the first chamber 1 will rise again. As soon as the level has risen to such an extent that the leak replenishment valve is again completely beneath the level of the working fluid then no more gas is passed into the hydraulic chamber and the metering power rises again. The gas contained in the hydraulic chamber can be discharged by way of a venting valve.

Figure 4:
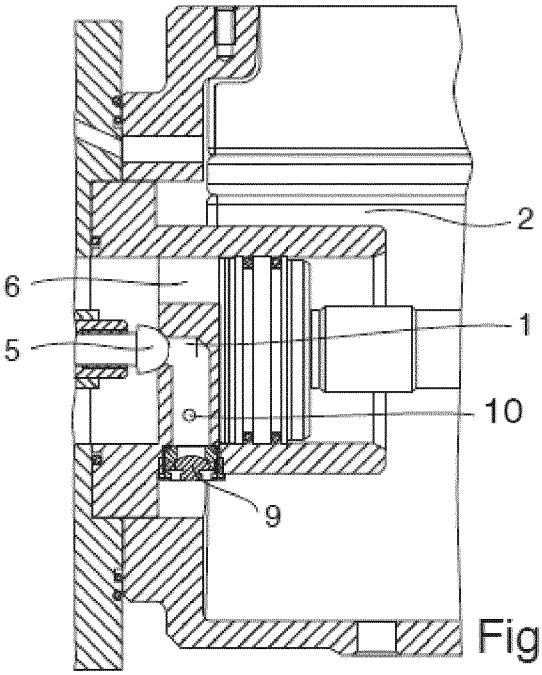

FIG. 4 shows a partial sectional view of a second embodiment according to the invention. This differs from the first embodiment substantially in that there is no second connecting passage functioning as a pressure equalization means and the connection of the first and second chambers is closed by a non-return valve 9 which prevents a flow of working fluid from the second chamber 2 into the first chamber 1 and has a by-pass 10 which is of a small cross-section so that working fluid can flow to a slight extent from the second chamber 2 into the first chamber 1.

Figure 4A:
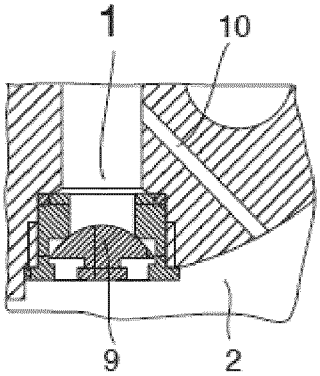

FIG. 4*a* shows the non-return valve 9 with by-pass 10 on an enlarged scale. It will be seen that the by-pass line 10 provides a direct communication between the first chamber 1 and the second chamber 2.

Figure 5:
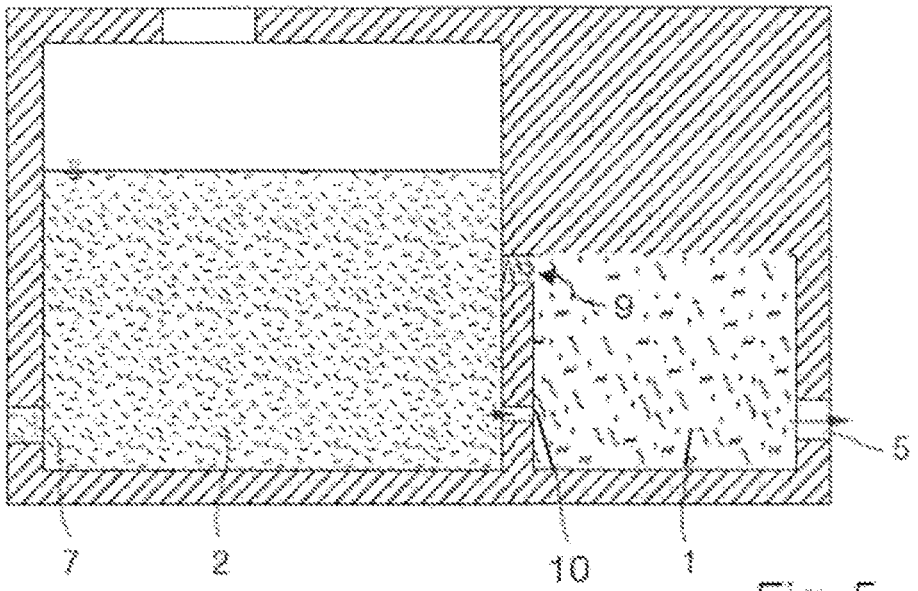

FIG. 5 is a diagrammatic view showing the mode of operation of the embodiment of FIG. 4.

In normal operation the loss of working fluid in the hydraulic chamber is so slight that, during a complete stroke, the amount of working fluid added by way of the leak replenishment valve 5 can easily be passed through the by-pass 10 from the second chamber into the first chamber.

In the overpressure situation however a larger amount of hydraulic fluid is abruptly let out of the hydraulic chamber and fed to the second chamber 2 of the working fluid supply again by way of a suitable pressure limiting valve and by way of the feed means 7. In the overpressure situation there is an unwanted rise in temperature not only of the recycled hydraulic oil but also of the pressure limiting valve (not shown).

The fact that the working fluid supply is divided according to the invention into two chambers connected by a narrow first connecting passage provides however in the overpressure mode of operation that during a stroke it is no longer possible for sufficient working fluid to flow from the second chamber into the first chamber in order to compensate for the loss of working fluid by way of the pressure replenishment valve.

As a consequence the result of this is that, by virtue of the lack of pressure equalization in the overpressure situation, more working fluid is discharged from the chamber 1 into the hydraulic chamber 6 than can flow by way of the by-pass 10 from the second chamber 2 into the first chamber 1 so that the pressure in the first chamber rapidly falls. This has the consequence that cavitation occurs, that is to say the working fluid outgases and the resulting gas is transported by way of the leak replenishment valve into the hydraulic chamber, which likewise leads to an incomplete stroke whereby the energy introduced into the pump is reduced and the temperature is reduced.

As soon as the overpressure mode of operation is concluded, that is to say a blockage which is possibly present in the pressure line, has been removed, the pressure limiting valve will no longer open and therefore a relatively large amount of hydraulic oil will not leave the hydraulic chamber. In that situation once again more working fluid will flow from the second chamber into the first chamber by way of the by-pass 10, than working fluid is passed from the first chamber 1 into the hydraulic chamber by way of the leak replenishment valve 5 so that the pressure in the first chamber 1 will rise again. As soon as the pressure has correspondingly risen again no further cavitation will occur and the metering power rises again. The gas contained in the hydraulic chamber can be discharged by way of a venting valve.

In the disturbance mode of operation in respect of the diaphragm position, for example upon a blockage in the suction line, the leak replenishment valve opens and the excessively large volume of hydraulic oil can flow by way of the first chamber 1 and the opening non-return valve 9 at a slightly increased pressure into the second chamber 2 without the diaphragm suffering damage.

Figure 6:
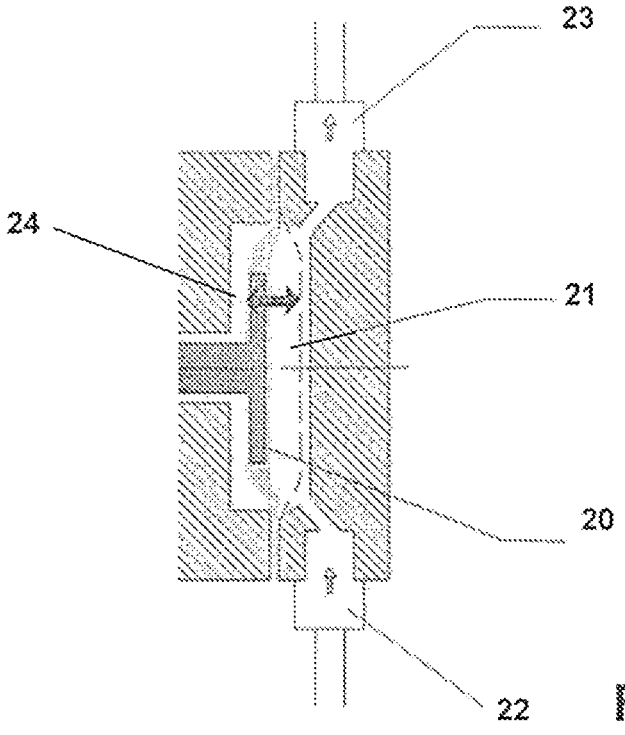
FIG. 6 is a partial sectional view of a first embodiment of the present invention.

FIG. 6 is a partial sectional view of the first embodiment of the present invention showing the diaphragm 20, the delivery chamber 21, the suction connection 22, the pressure connection 23 and the hydraulic chamber 24, the arrows showing the direction of movement of the diaphragm and flow of fluid from the suction connection 22 to the pressure connection 23.

Figure 7:
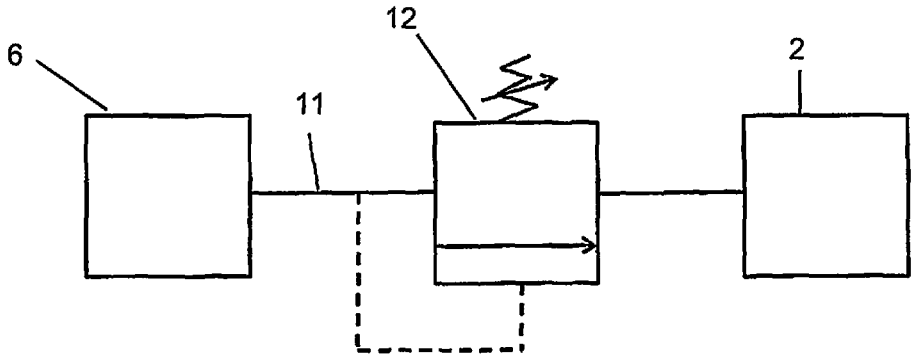
FIG. 7 is a partial diagrammatic view of a first embodiment of the present invention showing the hydraulic chamber connected to a working fluid supply chamber through an outlet passage controlled by a pressure relief valve.

FIG. 7 is a diagrammatic view of the first embodiment of the present invention showing the hydraulic chamber 6 connected via the outlet passage 11 to the second working fluid supply chamber 2. Flow of working fluid through the outlet passage 11 is controlled by the pressure relief valve 12.

LIST OF REFERENCES

1 first chamber
2 second chamber

3 second connecting passage
4 nozzle/first connecting passage
5 leak replenishment valve
6 hydraulic chamber
7 feed means
9 non-return valve
10 by-pass

The invention claimed is:

1. A diaphragm pump comprising a delivery chamber separated from a hydraulic chamber by way of a diaphragm, wherein the delivery chamber is respectively connected to a suction connection and a pressure connection and the hydraulic chamber which can be filled with a working fluid can be acted upon with a pulsating working fluid pressure and the diaphragm can be reciprocated between a pressure position in which the volume of the delivery chamber is smaller and a suction position in which the volume of the delivery chamber is larger, wherein the hydraulic chamber is connected to a working fluid supply by way of a leak replenishment valve, wherein the leak replenishment valve is so designed that when the pressure in the hydraulic chamber in the suction position of the diaphragm is less than a predetermined minimum value pMin the leak replenishment valve opens and the hydraulic chamber has an outlet passage which is closed by a pressure limiting valve which is so designed that if the pressure in the hydraulic chamber rises above a predetermined maximum value pMax the pressure limiting valve opens so that working fluid can leave the hydraulic chamber by way of the outlet passage, characterised in that the working fluid supply is arranged in a first working fluid supply chamber and in a second working fluid supply chamber, the two chambers being connected together by way of a first connecting passage, the first connecting passage being closeable, the outlet passage being connected to the second working fluid supply chamber, the outlet passage ending in the second working fluid supply chamber, the leak replenishment valve being arranged between the hydraulic chamber and the first working fluid supply chamber; further including a valve for closing the first connecting passage.

2. A diaphragm pump as set forth in claim 1 characterised in that the leak replenishment valve has a closing member which is reciprocable between a closed position in which the valve passage is closed and an open position in which the valve passage is opened and which is held in the closed position by means of a pressure element, wherein the pressure element is so designed that when the pressure in the hydraulic chamber is less than a setting pressure pMin the closing member moves in the direction of the open position.

3. A diaphragm pump as set forth in claim 1 characterised in that the first connecting passage is arranged lower than the leak replenishment valve.

4. A diaphragm pump as set forth in claim 3 characterised in that there is provided a second connecting passage between the first chamber and the second chamber, wherein the second connecting passage is arranged above the first connecting passage.

5. A diaphragm pump as set forth in claim 4 characterised in that the first chamber is so designed that working fluid can pass from the second chamber into the first chamber only by way of the first connecting passage.

6. A diaphragm pump as set forth in claim 5 characterised in that the second connecting passage is closed by a non-return valve, the through-flow direction of the non-return valve being arranged in the direction of the second chamber.

7. A diaphragm pump comprising a delivery chamber separated from a hydraulic chamber by way of a diaphragm, wherein the delivery chamber is respectively connected to a suction connection and a pressure connection and the hydraulic chamber which can be filled with a working fluid can be acted upon with a pulsating working fluid pressure and the diaphragm can be reciprocated between a pressure position in which the volume of the delivery chamber is smaller and a suction position in which the volume of the delivery chamber is larger, wherein the hydraulic chamber is connected to a working fluid supply by way of a leak replenishment valve, wherein the leak replenishment valve is so designed that when the pressure in the hydraulic chamber in the suction position of the diaphragm is less than a predetermined minimum value pMin the leak replenishment valve opens and the hydraulic chamber has an outlet passage which is closed by a pressure limiting valve which is so designed that if the pressure in the hydraulic chamber rises above a predetermined maximum value pMax, the pressure limiting valve opens so that working fluid can leave the hydraulic chamber by way of the outlet passage, characterised in that the working fluid supply is arranged in a first working fluid supply chamber and in a second working fluid supply chamber, the two chambers being connected together by way of a first connecting passage, the outlet passage being connected to the second working fluid supply chamber, the outlet passage ending in the second working fluid supply chamber, the leak replenishment valve being arranged between the hydraulic chamber and the first working fluid supply chamber, further including a valve for closing the first connecting passage; characterised in that the flow through the connecting passage is throttled so that in an overpressure situation, when hydraulic oil has left the hydraulic chamber by way of the pressure limiting valve, more hydraulic oil is passed out of the first chamber into the hydraulic chamber than can flow during a stroke from the second chamber into the first chamber.

8. A diaphragm pump as set forth in claim 1 characterised in that the flow through the connecting passage can be throttled so that in an overpressure situation, when hydraulic oil has left the hydraulic chamber by way of the pressure limiting valve, more hydraulic oil is passed out of the first chamber into the hydraulic chamber than can flow during a stroke from the second chamber into the first chamber.

9. A diaphragm pump as set forth in claim 3 characterised in that there is provided a second connecting passage between the first chamber and the second chamber, wherein the second connecting passage is arranged above the first connecting passage and above the leak replenishment valve.

10. A diaphragm pump as set forth in claim 3 characterised in that there is provided a second connecting passage between the first chamber and the second chamber, wherein the second connecting passage is arranged above the first connecting passage and above the leak replenishment valve, wherein the second connecting passage is arranged above the level of working fluid in the second chamber.

11. A diaphragm pump as set forth in claim 7 characterised in that the leak replenishment valve has a closing member which is reciprocable between a closed position in which the valve passage is closed and an open position in which the valve passage is opened and which is held in the closed position by means of a pressure element, wherein the pressure element is so designed that when the pressure in the hydraulic chamber is less than a setting pressure pMin the closing member moves in the direction of the open position.

12. A diaphragm pump as set forth in claim 7 characterised in that the first connecting passage is arranged lower than the leak replenishment valve.

13. A diaphragm pump as set forth in claim 12 characterised in that there is provided a second connecting passage between the first chamber and the second chamber, wherein the second connecting passage is arranged above the first connecting passage.

14. A diaphragm pump as set forth in claim 13 characterised in that the first chamber is so designed that working fluid can pass from the second chamber into the first chamber only by way of the first connecting passage.

15. A diaphragm pump as set forth in claim 14 characterised in that the second connecting passage is closed by a non-return valve, the through-flow direction of the non-return valve being arranged in the direction of the second chamber.

16. A diaphragm pump comprising a delivery chamber separated from a hydraulic chamber by way of a diaphragm, wherein the delivery chamber is respectively connected to a suction connection and a pressure connection and the hydraulic chamber which can be filled with a working fluid can be acted upon with a pulsating working fluid pressure and the diaphragm can be reciprocated between a pressure position in which the volume of the delivery chamber is smaller and a suction position in which the volume of the delivery chamber is larger, wherein the hydraulic chamber is connected to a working fluid supply by way of a leak replenishment valve, wherein the leak replenishment valve is so designed that when the pressure in the hydraulic chamber in the suction position of the diaphragm is less than a predetermined minimum value pMin the leak replenishment valve opens and the hydraulic chamber has an outlet passage which is closed by a pressure limiting valve which is so designed that if the pressure in the hydraulic chamber rises above a predetermined maximum value pMax the pressure limiting valve opens so that working fluid can leave the hydraulic chamber by way of the outlet passage, characterised in that the working fluid supply is arranged in a first and in a second chamber, the two chambers being connected together by way of a first connecting passage, wherein the first connecting passage is arranged lower than the leak replenishment valve, wherein there is provided a second connecting passage between the first chamber and the second chamber, wherein the second connecting passage is arranged above the first connecting passage, wherein the first chamber is so designed that working fluid can pass from the second chamber into the first chamber only by way of the first connecting passage, and wherein the second connecting passage is closed by a non-return valve, the through-flow direction of the non-return valve being arranged in the direction of the second chamber.

* * * * *